United States Patent [19]

Hirschmann

[11] Patent Number: 4,959,591

[45] Date of Patent: Sep. 25, 1990

[54] RECTIFIER-INVERTER CIRCUIT WITH LOW HARMONIC FEEDBACK, PARTICULARLY FOR OPERATION OF FLUORESCENT LAMPS

[75] Inventor: Walter Hirschmann, Munich, Fed. Rep. of Germany

[73] Assignee: Patent Treuhand Gesellschaft für elektrische Glühlampen m.b.H., Munich, Fed. Rep. of Germany

[21] Appl. No.: 388,642

[22] Filed: Aug. 2, 1989

[30] Foreign Application Priority Data

Aug. 30, 1988 [DE] Fed. Rep. of Germany ..... 3829388

[51] Int. Cl.[5] ..... H05B 41/29

[52] U.S. Cl. ..... 315/209 R; 315/205; 315/226; 315/291

[58] Field of Search ..... 315/200 R, 205, 209 R, 315/226, 291, DIG. 2, DIG. 5

[56] References Cited

U.S. PATENT DOCUMENTS 4,782,268 11/1988 Fahnrich et al. ..... 315/200 R

FOREIGN PATENT DOCUMENTS 2022943 12/1979 United Kingdom .

OTHER PUBLICATIONS

"Neue Leuchten und Vorschaltgerate mit reduzierter Aschlussleistung", New Lamps and Auxiliary Circuits with Reduced Power Take-Up), Siemens Energietechnik (Energy Technology) 2, 1981 Issue 5.

W. Hirschmann: "Eletronikschaltungen" (Electronic Circuits) Siemens AG, 1982, p. 148.

O. Mackek: "Schaltnetzteile-Motorsteuerungen" (Circuit Components—Motor Controls), Huthig, publishers, 1982.

Siemens: Switched-Mode Power Supplies (SMPS) Technology and Components—Aug. 1985.

*Primary Examiner*—David Mis

*Attorney, Agent, or Firm*—Frishauf, Holtz, Goodman & Woodward

[57] ABSTRACT

To ensure synchronous operation of push-pull connected oscillator transistors (T1, T2), receiving rectified power via a rectifier (GL) from a power network (U), in which the circuit includes an elevated voltage maintenance or step-up converter circuit having a choke (L2), a switching transistor (T3) and a diode - capacitor circuit (D5, C2), the switching transistor (T3) is controlled from the same source of control voltage as the push-pull connected oscillator transistors (T1, T2), for example by coupling the base of the switching transistor (T3) to receive control energy from a feedback coil (RK3) of a feedback transformer (RK1, RK2, RK3) also supplying feedback energy to the push-pull oscillator transistors (T1, T2). The switching transistor (T3) can be controlled by a controllable resistor (R2) connected to its base, which may receive a control voltage through a control amplifier (FIG. 3: RV) representative of voltage levels in the circuit. A further transistor (T4) can be connected serially between the rectifier (GL) and the choke (L2) of the step-up converter circuit which improves approximation of sinusoidal wave form and voltage level maintenance of the circuit, the further transistor (T4) being likewise controlled from the same energy source as the switching transistor (T3).

19 Claims, 3 Drawing Sheets

RECTIFIER-INVERTER CIRCUIT WITH LOW HARMONIC FEEDBACK, PARTICULARLY FOR OPERATION OF FLUORESCENT LAMPS

Reference to related publications:

British Patent No. 2,022,943, Haberzeth "Neue Leuchten und Vorschaltgeräte mit reduzierter Anschlussleistung" ("New Lamps and Auxiliary Circuits with Reduced Power Take-Up"), SIEMENS Energietechnik ("Energy Technology") 3, 1981, Issue 5.

W. Hirschmann: "Elektronikschaltungen" ("Electronic Circuits"), Siemens AG, 1982 p. 148.

O. Macek: "Schaltnetzteile—Motorsteuerungen" ("Circuit Components—Motor Controls"). Hüthig, publishers 1982.

Reference to related patent, assigned to the assignee of the present invention, the disclosure of which is hereby incorporated by reference:

U.S. Pat. No. 4,782,268, Fähnrich and Hirschmann.

The present invention relates to a rectifier-inverter circuit for operation of a load from an a-c power network, in which the load is operated at a frequency which is high with respect to the power network frequency, which includes inductive components, and which is particularly adapted to operate gas discharge lamps, such as fluorescent lamps.

BACKGROUND

Inverter circuits which include inductive elements feed back harmonics into the power network. In order to prevent degradation of the wave forms in the power network, it is usually necessary to include a passive or active harmonic filter in the inverter circuit. Some inverter circuits include an oscillator circuit which may be supplied from the rectifier through a network which provides for voltage maintenance; they are also referred to as "step-up converter circuits" and, typically, include a controlled element, such as a transistor, in a circuit with energy storage devices such as an inductance and a capacitor. The transistor is pulsed to provide for storage of energy in the energy storage devices to be released to bridge gaps in energy supplied during drop in input voltage.

The controlled element, typically the transistor, requires control from a clock source in order to limit the harmonics in the current taken up from the a-c power network to values which are acceptable to the power company, and/or to communication companies which may be affected by excessive harmonics in the power supply. Such standards are known and one such standard is that published by the German Society of Electrical Engineers, VDE 0712.

Circuits which control the switched transistor usually were separately provided for this transistor. The wave form of such circuits also has to be controlled so that it is essentially sinusoidal. All this requires complex external control circuitry.

Step-up converters and the like, also referred to as boost converters, since the output voltage can be greater than the input voltage, are known and described, for example, in the printed publication "Siemens Schaltnetzteile (SNT), Technik und Bauelemente, Technische Mitteilung", pp. 14–15, published March 1985, and also available in the English translation entitled "Switched-Mode Power Supplies (SMPS), Technology and Components, Application Note", published in English in August 1985. A step-up converter circuit with specific provision for sinusoidal control is described in British Patent No. 2,022,943, Haberzeth (assigned Siemens, Fed. Rep. Germany). A step-up converter, which does not have any special control circuit for sinusoidal wave form and adapted as an accessory or auxiliary circuit for fluorescent lamps is described in the referenced literature: "Neue Leuchten und Vorschaltgeräte mit reduzierter Anschlussleistung" ("New Lamps and Auxiliary Circuits with Reduced Power Take-Up"), SIEMENS Energietechnik ("Energy Technology") 3, 1981, Issue 5. The circuit includes a step-up converter connected as a harmonic filter and a push-pull frequency generator to provide lamp energy. The current wave form accepted from the network is roughly triangular, and meets power company and engineering standard requirements with respect to the harmonics. The circuit utilizes different clocking or control frequencies for the step-up converter transistor and for the push-pull amplifier. It has been found that interferences arise in this type of operation.

The basic and known operation of step-up converters can be derived from any well-known literature relating to switched circuits and, for example, also from the referenced literature: O. Macek: "Schaltnetzteile-Motorsteuerungen" ("Circuit Components—Motor Controls"), Hüthig, publishers.

THE INVENTION

It is an object to provide a circuit arrangement including a step-up converter in which interference between frequencies in the operating frequency of the step-up converter and of the push-pull amplifier is eliminated, which does not require special sine wave shaping control, are inexpensive and simple.

Briefly, a control circuit for supply of a load from an a-c network through a rectifier-inverter circuit which includes a push-pull oscillator and an inductive circuit as a step-up converter is provided in which, in accordance with the invention, the switching transistor of the step-up converter is operated in synchronism with the switching of the transistors of the oscillator circuit. This is easily obtained, simply and inexpensively, by a circuit connection coupling the transformer in the feedback network of the oscillator circuit also to the control electrode of the switching transistor of the step-up converter.

The circuit has the advantage that switching of the switching transistor of the step-up converter thus is controlled from the very same source which supplies feedback energy to the push-pull transistors of the push-pull oscillator circuit, thereby ensuring synchronous operation.

The switching transistor for the step-up converter, in accordance with a preferred feature of the invention, has its base coupled to the very same transformer which also supplies the transistors of the push-pull frequency generator furnishing the energy to the load. Thus, the clocking source for switching of the energy supply transistors and the step-up converter transistor will be the same, thereby excluding any possible interferences. This circuit has the further advantage that separate control circuits for the switching transistor of the step-up converter are not needed since the control of this switching transistor is obtained from a component already present in the circuit, namely the transformer providing feedback energy for the energy supply to the push-pull transistor circuitry.

In accordance with a preferred feature of the invention, a current saturating ring core transformer is used as the transformer element. Use of a ring core transformer of this type keeps losses to a minimum. The control winding of the transformer, by suitable selection of coupling elements and circuit parameters, can simultaneously supply the control energy for the transistor of the push-pull oscillator circuit connected to the negative terminal of the power supply and also the control energy for the base of the switching transistor of the step-up converter circuit. This, further, simplifies the circuit arrangement.

DRAWINGS

DETAILED DESCRIPTION

Figure 1:
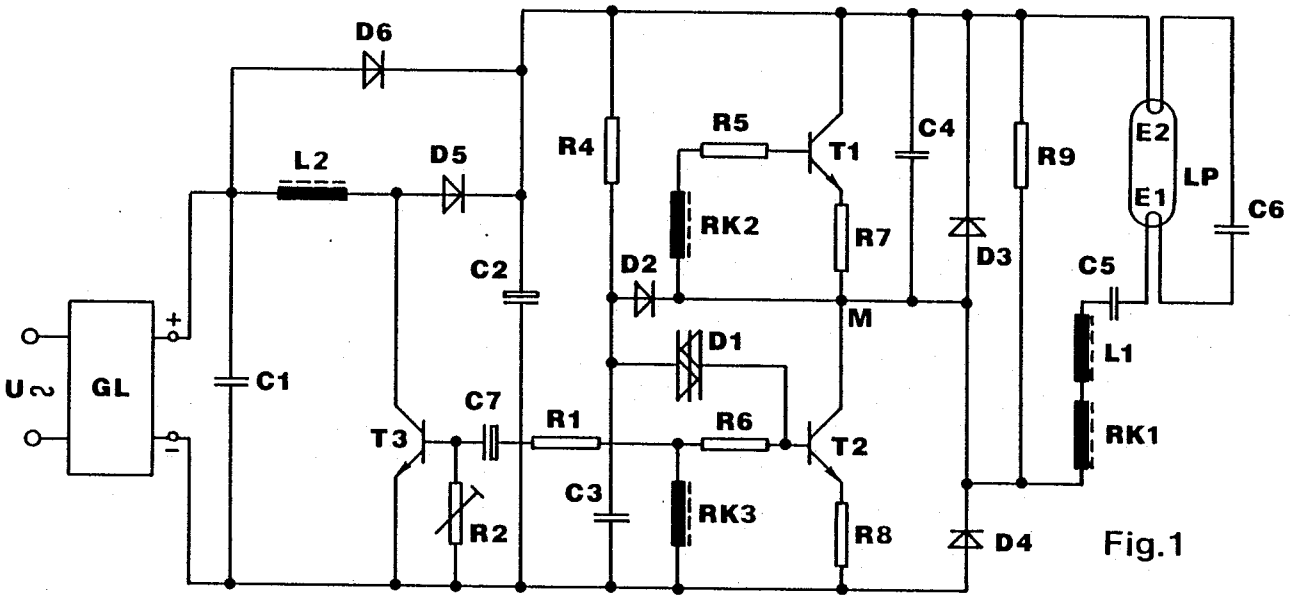
FIG. 1 is a circuit diagram of the rectifier-inverter circuit connected to operate a fluorescent lamp from an a-c power network.

The present invention will be described in connection with a high-frequency power supply for a low-pressure discharge lamp, typically a fluorescent lamp LP, from an a-c power network, for example of 110 or 220 V, at 60 or 50 Hz.

An input voltage U is applied to a standard rectifier GL, for example a full-wave diode rectifier. The output terminals marked plus and minus have a first or rectifier capacitor C1 connected thereacross.

Lamp energy is supplied at an elevated frequency of between 10 to 100 kHz, e.g. about 35 kHz, from a push-pull oscillator or frequency generator formed by two transistors T1, T2, each of which have bypass diodes D3, D4 connected across the main current carrying path thereof. The transistors T1, T2 have emitter-resistors R7, R8 serially connected to the emitters. They receive a control voltage through feedback windings RK2 and RK3 from a feedback transformer having a primary winding RK1 serially connected with the lamp LP. A starting capacitor C3 connected serially with a starting resistor R4 is connected across the power supply. Diode D2 is coupled to the junction between the capacitor C3 and resistor R4 and to a common junction M between the collector of transistor T2 and the emitter and emitter-resistor of transistor T1 and resistor R7, respectively. The starting circuit further includes a diac D1. A capacitor C4 is connected across the collector of transistor T1 and the common junction M.

The oscillator operates in conjunction with the transformer windings RK1, RK2, RK3 based on the well-known transformer feedback connection. The windings RK1, RK2, RK3 of the transformer are on a common ring core. The load, represented by the fluorescent lamp LP, has one terminal of electrode E1 coupled to the center junction M of the supply transistors T1, T2, and the other electrode E2 to the positive or plus terminal of the power supply rectifier GL.

A series resonance circuit formed by an inductance L1, coupling capacitor C5 and resonance capacitor C6, is provided. The inductivity of inductance L1 combined with the capacitance of capacitor C5 are connected in series between the primary winding RK1 of the transformer and the corresponding terminal of the electrode E1. The resonance capacitor C6 is connected to the heater terminals of the fluorescent lamp remote from the terminals connected to the resonance circuit and the positive supply from the rectifier of the electrodes E1, E2.

The operation of such a circuit is well known and reference may be had to the cited literature W. Hirschmann: "Elektronikschaltungen" ("Electronic Circuits"), Siemens AG, 1982, p. 148; it is also described in U.S. Pat. No. 4,782,268, Fähnrich and Hirschmann, assigned to the assignee of the present application, the disclosure of which is hereby incorporated by reference.

A step-up converter circuit is coupled between the capacitor C1 and the energy supply circuit for the push-pull generator which includes the transistors T1, T2 and associated circuit components. The step-up converter is formed by an inductance or choke L2, a diode D5, a switching transistor T3, and a smoothing or output capacitor C2. The operation of the step-up converter circuit is well known and is described, for example, in detail in the referenced literature O. Macek: "Schaltnetzteile—Motorsteuerungen" ("Circuit Components-Motor Controls"), Hüthig, publishers.

In accordance with a feature of the present invention, the transistor T3 operates in synchronism with switching of the transistors T1, T2. To ensure such synchronous operation, the base of transistor T3 is connected through the series circuit of a coupling capacitor C7 and a resistor R1 to the control circuit which controls the transistor T2, namely by being connected to a junction between the control winding RK3 of the control transformer for transistor T2 and the respective coupling resistor R6. The base of the transistor T3 is, additionally, connected through an adjustable resistor R2 with the emitter of transistor T3.

The choke or inductance L2 and the diode D5 are serially connected; a diode D6 is connected across the series circuit formed by choke L2 and diode D5.

The circuit as described causes switching of the transistor of the step-up converter in synchronism with the switching of the transistors T1, T2 of the push-pull amplifier. Resistor R1 has the function to limit current; resistor R2 adjusts the duty cycle of the transistor T3, and thus also controls or sets the d-c voltage on the smoothing capacitor C2. This, also, sets the supply voltage for the push-pull frequency generator. The diode D6 bridges the step-up converter in case the frequency generator is subject to short-time overloading.

Figure 2:
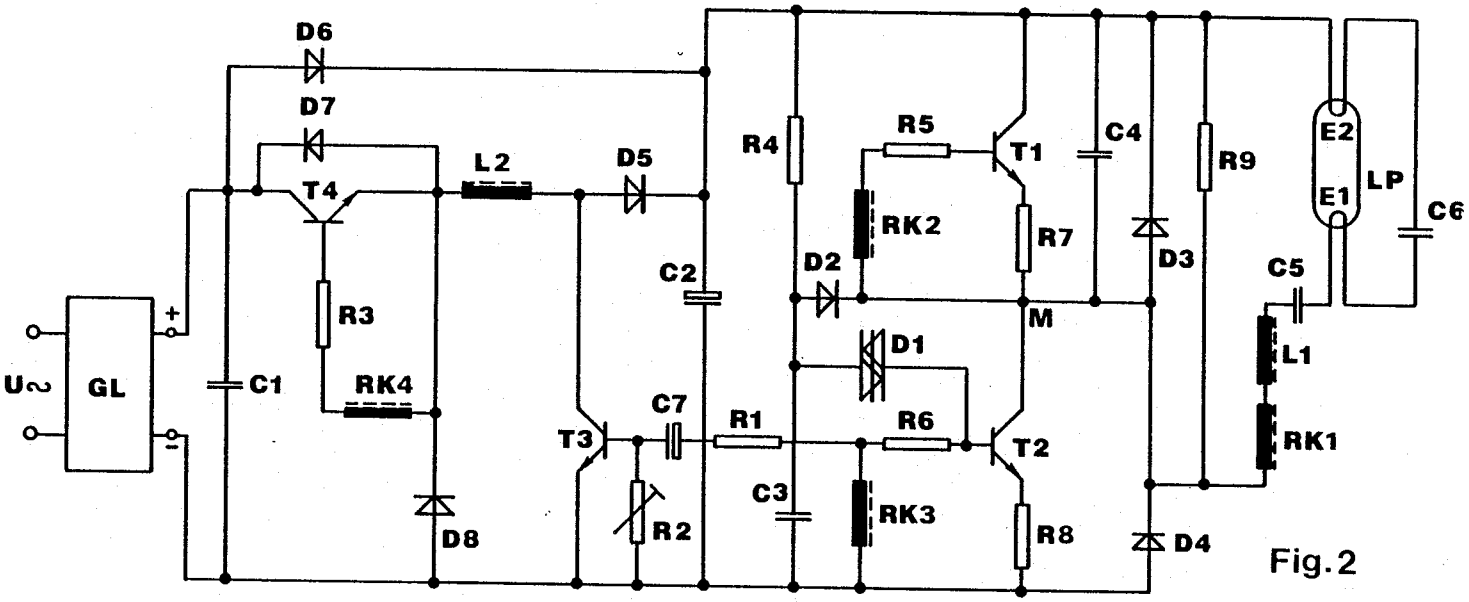
FIG. 2 is a circuit diagram similar to FIG. 1 and including additional circuit components for improved wave forms.

FIG. 2 illustrates a modification of the circuit, and also shows the circuit in combination with a fluorescent lamp. The same reference numerals have been used for like circuit elements, which will not be described again.

FIG. 2 shows a further switching transistor T4, having its collector-emitter path connected between the positive terminal of the rectifier GL and one terminal of the choke L2 of the step-up converter. The transistor T4 is part of the step-up converter, the collector-emitter path being connected in d-c current flow connection. The base of the transistor T4 is coupled via a coupling resistor R3 to a further secondary winding RK4 of the transformer RK1, RK2, RK3. The junction of the base and the emitter of the switching transistor T4 is connected to a diode D8 which is polarized in current conductive direction towards the emitter, that is, in blocking direction connected to the negative terminal of the rectifier GL. The collector-emitter path of the switching transistor T4 is bridged by a free-wheeling diode D7, polarized in reverse current flow direction.

The additional circuit elements, transistor T4 with its control winding RK4 and coupling elements, provide for clamping of the choke L2 to zero or reference voltage upon its discharge. The result will be that a sufficient voltage level difference can be maintained which ensures sufficient approximation to sinusoidal wave form at essentially uniform duty cycles $t \leqq 0.5$ T, wherein t is the operating time of the transistor and T is the duration of one period. The voltage across capacitor C2 is constrained to rise only slightly above that of power supply voltage. It is possible, in this circuit, to omit the diode D6. In such operation, voltages lower than network voltages can be obtained across the capacitor C2.

Suitable circuit components for operating a fluorescent lamp LP of nominally 36 W energy consumption from a 220 V, 50 Hz power supply network are listed in the attached table which forms part of the present specification.

Figure 3:
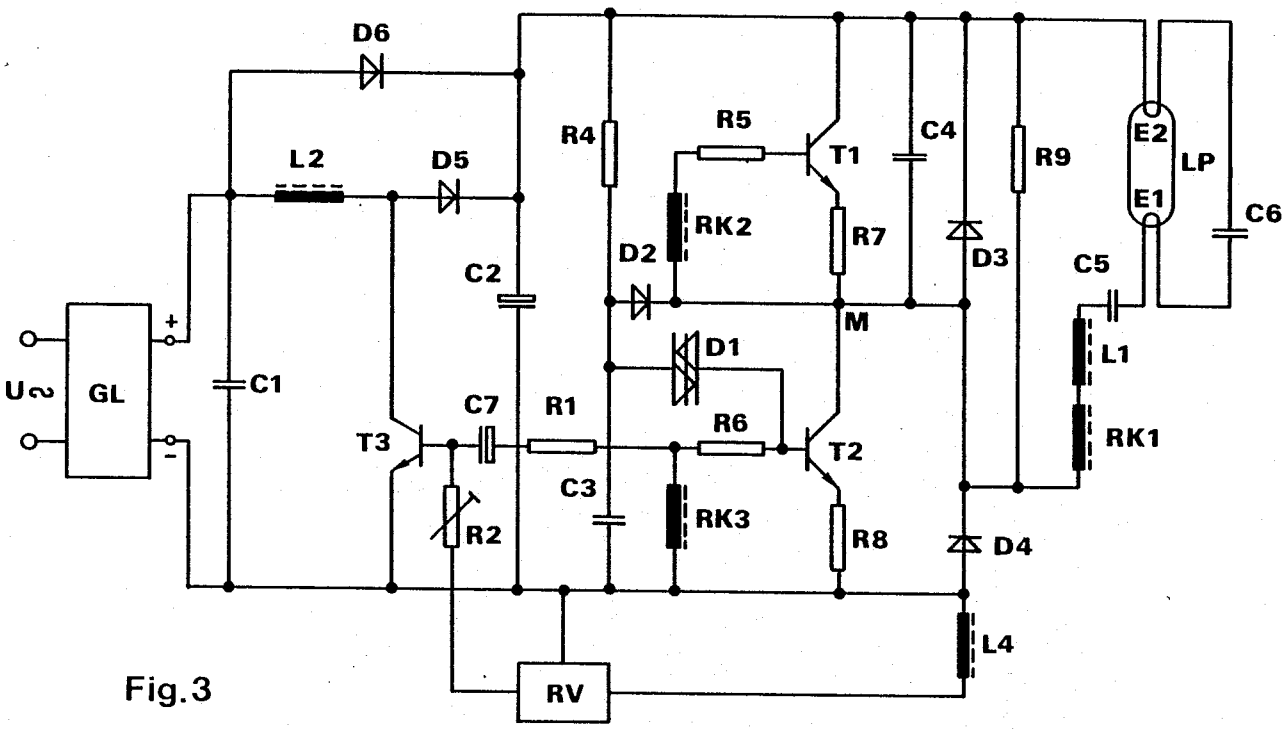
FIG. 3 is a circuit diagram similar to FIG. 1 with an additional control amplifier to compensate for power network voltage variations.

FIG. 3 illustrates a circuit similar to FIG. 1 which additionally includes a control amplifier RV. The control amplifier is coupled to the adjustable resistor R2 and hence to the base of the step-up converter switching transistor T3. The voltage supply of the control amplifier RV is obtained from a secondary winding L4 coupled to the choke L1 in the load circuit, that is, in series with the lamp LP. The control circuit RV is, additionally, connected to the negative terminal of the rectifier GL.

The control amplifier RV supplies a d-c voltage to the variable resistor R2. This permits control of the supply voltage across the capacitor C2, forming the supply voltage for the push-pull amplifier formed by transistor T1, T2 and associated networks to a constant or uniform level.

The circuit can be used with loads of various types and is not limited to merely supplying one fluorescent lamp. It can be used, also, to supply high-pressure discharge lamps, such as metal halide mercury high-pressure discharge lamps. No changes or modifications of the circuit are necessary to supply such other loads; to operate high-pressure discharge lamps, it may, however, be necessary to provide an additional lamp ignition circuit.

Controlling the step-up converter switching transistor T3 through the base from a ring core transformer operating in current saturation condition through a capacitor and coupling resistor R1, has the advantage that synchronous switching of the transistor T3 and the switching of the push-pull oscillating transistors T1, T2 will always be maintained. The duty cycle of the transistor T3 can be readily controlled by changing the resistance value of the adjustable resistor R2.

Diode D6 ensures that the push-pull amplifier will receive at all times sufficient energy, and is particularly desirable in case of overloading of the push-pull amplifier and to ensure reliable starting.

The voltage at the output of the step-up converter circuit, that is, the voltage across capacitor C2, normally, in all operating conditions is higher than the peak voltage available immediately at the output of the rectifier GL, that is, for example across the capacitor C1. When the switching transistor T3 is blocked before the choke L2 saturates, counter-inductance in the choke causes current to flow through the diode D5 into the smoothing capacitor C2 until the energy stored in the choke is no longer sufficient. The capacitor C, connected across the output terminals of the rectifier GL, thus clamps the choke and stores energy flowing therefrom, so that the energy content of the capacitor C1 is added to that energy which is still present in the choke. As a consequence, the output voltage of the step-up converter circuit is increased. This requires the capacitor C2 to have an operating voltage level higher than that of the capacitor C1.

The output voltage of the step-up converter circuit can be further controlled by use of the circuit of FIG. 2 in which the further switching transistor T4 has its collector-emitter path connected in current flow direction, the further transistor T4 being controlled from the same transformer as that which controls the transistors T1, T2 of the oscillator as well as the switching transistor T3 of the step-up converter circuit. The base of the further transistor T4 specifically is connected through the coupling or limiting resistor R3 to the fourth additional winding RK4, coupled to the cathode of diode D8, the anode of which is connected to the negative or minus terminal of the rectifier GL. The further switching transistor T4 and diode D8, connected in reverse conductivity direction, alternatingly clamps the inductance L2 of the step-up converter to either input voltage or zero or reference voltage. This ensures a substantial voltage difference at the inductance which, in turn, ensures that the output voltage at the smoothing or filter capacitor C2 rises only slightly above the peak voltage across capacitor C1, which, in turn, ensures that the current accepted from the power supply network at terminals U is very close to sinusoidal form. Control of the transistor T4 through the very same transformer which controls the remaining transistors also ensures synchronous operation of all transistors. This circuit, also, permits elimination of a further special control circuit for the transistor T4 merely by adding another winding to the ring core transformer.

The collector-emitter path of transistor T4 is bridged by the diode D7, again reversely polarized with respect to current flow. This eliminates and bypasses dangerous voltage peaks which might otherwise occur at the transistor T4 during pulse gaps or during transitional phases.

Use of a control amplifier RV (FIG. 3) has the advantage that the control amplifier can receive a control signal which is directly related to the level of voltage of a voltage supply circuit. Thus, by coupling the windings L4 and L1 on the same core, a voltage-dependent signal will be obtained which can be fed back to control the operation of the step-up converter switching transistor T3. It is not necessary that the control amplifier RV receive its control signal from the choke or inductance L1. The coil L4 could also be coupled to the core of the feedback transformer RK1, RK2, RK3—and if the circuit of FIG. 2 is used, RK4; alternatively, the coil L4 can be coupled to the choke or inductance L2. Alternatively, the control amplifier may receive its signal and voltage supply over a separate transformer coupled to the center tap M of the push-pull frequency generator, provided the additional coupling transformer is isolated with respect to direct current. The control amplifier RV, receiving, thus, an input signal representative of input voltage, then controls the switching transistor in such a direction that voltage variations at the input to the rectifiers GL, and hence appearing at capacitors C1 and C2, can be compensated, without, essentially, changing the wave shape of the current accepted by the rectifier GL, and hence affecting the supply network.

Various changes and modifications may be made, and any features or circuits described in connection with any one of the embodiments may be used with any of the others, within the scope of the inventive concept.

TABLE

| | |
|---|---|
| GL | B 250, C 1000 |
| C1, C5 | 47 nF |
| T1-T4 | BUV 93 |
| D3-D8 | 1 N 4937 |
| R1, R3 | 4,7 Ω |
| R2 | 1 k Ω |
| R4 | 470 Ω |
| L2 | EF 20, 2.85 mH |
| C2, C7 | 4.7 μF |
| C3 | 100 nF |
| D1 | A 9903 |
| D2 | 1 N 4004 |
| R5, R6 | 10 Ω |
| R7, R8 | 1.5 Ω |
| C4 | 4.7 nF |
| R9 | 230 kΩ |
| L1 | EF 20, 2,3 mH |
| C6 | 6.8 nF |
| RK1-RK4 | RK 13 × 7 × 5, n1 = 7 windings<br>n2-n4 = 2 windings |

I claim:

1. Rectifier - inverter circuit for operation of a load (LP) by supplying the load with electrical energy from an a-c power network, at an elevated frequency high with respect to the power network frequency, having a rectifier circuit (GL) coupled to the power network;

a first capacitor (Cl) connected across the output terminals of rectifier;

a push-pull oscillator circuit for providing said electrical energy at said elevated frequency, coupled to the output of the rectifier, said push-pull oscillator circuit including two transistors (T1, T2), a feedback circuit including a transformer having a first winding (RK1) in circuit with the load, and feedback winding means (RK2, RK3) in circuit with the transistors;

an inductance (L1) connected between the output of the oscillator circuit and the load (LP); and an active harmonic filter circuit forming an elevated voltage maintenance, or step-up converter circuit coupled to the output of the rectifier circuit including a switching transistor (T3) having its switching path connected across the rectifier output;

a choke (L2) in series with the switching path of said switching transistor, and a diode (D5) and a second capacitor (C2) circuit, coupled in circuit with the switching path of the transistor, and comprising, in accordance with the invention, means for controlling the switching of the switching transistor (T3) and for ensuring synchronous operation of the switching transistor and the oscillator circuit including circuit connection means (C7, R1) coupled to said oscillate circuit and to the control electrode of the switching transistor (T3) to control switching of the switching transistor from the same source of energy which provides the elevated frequency energy.

2. The circuit of claim 1, wherein said circuit connecting means (C7, R1) are coupled to said transformer of the oscillator circuit to control switching of the switching transistor (T3) from the same source as the feedback energy for the push-pull transistors (T1, T2) of the oscillator circuit.

3. The circuit of claim 1, wherein said transformer is a ring core transformer operated in current saturation mode.

4. The circuit of claim 1, wherein said circuit connecting means (C7, R1) are coupled to said transformer of the oscillator circuit to control switching of the switching transistor from the same source as the feedback energy for the push-pull transistors (T1, T2) of the oscillator circuit;

wherein one (T2) of said transistors (T1, T2) is connected to the negative terminal of the rectifier circuit, said one transistor receiving feedback energy from one (RK3) of the feedback winding means of the transformer;

and wherein said one feedback winding means is coupled to the control electrode of said switching transistor (T3) of the elevated voltage maintenance or step-up converter circuit.

5. The circuit of claim 1, wherein said circuit connection means are coupled to said transformer and to the control electrode of said switching transistor (T3) and include a serial connection of a capacitor (C7) and a resistor (R1).

6. The circuit of claim 1, further comprising an adjustable resistor (R2) coupling the base of the switching transistor (T3) of the elevated voltage maintenance circuit or step-up converter circuit to a source of reference potential.

7. The circuit of claim 1, further including a bridging diode (D6) connected across said choke (L2) and said diode (D5) of the diode and second capacitor circuit, and polarized in conductive direction.

8. The circuit of claim 1, further including (FIG. 2) a further switching transistor (T4) serially connected between the output from the rectifier circuit (GL) and the elevated voltage maintenance or step-up converter circuit, said further switching transistor having its base coupled to a further winding (RK4) of said transformer.

9. The circuit of claim 8, further including a limiting resistor (R3) connected between the further winding (RK4) of said transformer and the base of the switching transistor (T4), and forming said coupling.

10. The circuit of claim 8, further including a further diode (D8) coupled between the emitter of the further transistor (T4) and the negative terminal of said rectifier circuit (GL).

11. The circuit of claim 8, including a protective diode (D7) connected across the collector-emitter path of the further switching transistor (T4) and polarized in reverse current carrying direction with respect to said further switching transistor.

12. The circuit of claim 1, further including a controllable resistor (R2) coupled to the base of said switching transistor (T3); and a control amplifier (RV) connected to said controllable resistor for applying a d-c voltage to the base of said switching transistor through said adjustable resistor.

13. The circuit of claim 12, wherein said control amplifier receives an input signal representative of voltage supply from said rectifier to said push-pull oscillator circuit.

14. The circuit of claim 12, wherein said inductance (L1), said choke (L2) and said transformer (RK1, RK2, RK3) form electromagnetic inductive means;

and further including an electromagnetic inductive coupling (L4) to said electromagnetic inductive means and providing an output voltage to said control amplifier (RV) to supply to said control amplifier a control voltage representative of voltage levels in said rectifier-inverter circuit.

15. The circuit of claim 12, further including a d-c decoupled inductive element forming a voltage transformer, said voltage transformer being coupled to a center or common connection (M) between said two transistors (T1, T2) and providing a control signal to said control amplifier (RV) representative of voltage level in said oscillator circuit.

16. The circuit of claim 1, in combination with a fluorescent lamp (LP), said fluorescent lamp forming said load.

17. The circuit of claim 2, in combination with a fluorescent lamp (LP), said fluorescent lamp forming said load.

18. The circuit of claim 4, in combination with a fluorescent lamp (LP), said fluorescent lamp forming said load.

19. The circuit of claim 6, in combination with a fluorescent lamp (LP), said fluorescent lamp forming said load.

* * * * *